US008062582B2

(12) United States Patent
Hammond et al.

(10) Patent No.: US 8,062,582 B2
(45) Date of Patent: Nov. 22, 2011

(54) POWDER METALLURGY METHODS AND COMPOSITIONS

(75) Inventors: Dennis L. Hammond, Richfield, OH (US); Richard Phillips, St. Marys, PA (US)

(73) Assignee: Apex Advanced Technologies, LLC, Cleveland, OH (US)

( * ) Notice: Subject to any disclaimer, the term of this patent is extended or adjusted under 35 U.S.C. 154(b) by 874 days.

(21) Appl. No.: 12/090,900

(22) PCT Filed: Oct. 2, 2006

(86) PCT No.: PCT/US2006/038253

§ 371 (c)(1),
(2), (4) Date: May 1, 2008

(87) PCT Pub. No.: WO2007/041399

PCT Pub. Date: Apr. 12, 2007

(65) Prior Publication Data

US 2009/0162236 A1 Jun. 25, 2009

(51) Int. Cl.
*B22F 1/02* (2006.01)
*B22F 3/12* (2006.01)

(52) U.S. Cl. ..... 419/36; 419/35

(58) Field of Classification Search ..... 75/252, 75/254; 419/30, 35, 36, 37
See application file for complete search history.

(56) References Cited

U.S. PATENT DOCUMENTS

| | | | | |
|---|---|---|---|---|
| 3,050,386 | A | 8/1962 | von Döhren et al. | |
| 5,290,336 | A | 3/1994 | Luk | |
| 5,602,350 | A | 2/1997 | German et al. | |
| 6,042,781 | A | 3/2000 | Lashmore et al. | |
| 6,679,935 | B2 | 1/2004 | Hammond | |
| 2002/0004540 | A1 * | 1/2002 | Hendrickson et al. | 523/205 |
| 2003/0063992 | A1 | 4/2003 | Crump et al. | |
| 2003/0109388 | A1 * | 6/2003 | Hammond | 508/450 |
| 2003/0220424 | A1 * | 11/2003 | Schofalvi et al. | 524/195 |
| 2004/0261904 | A1 | 12/2004 | Chen et al. | |
| 2005/0118053 | A1 * | 6/2005 | Phillips et al. | 419/36 |

FOREIGN PATENT DOCUMENTS

| | | |
|---|---|---|
| EP | 0351056 | 1/1990 |
| WO | 02/45889 A2 | 6/2002 |
| WO | WO2007041399 | 4/2007 |

OTHER PUBLICATIONS

CRC Handbook of Chemistry and Physics, 76th Edition (1995), Section 7-28, "Properties of Selected Fatty Acids".

CRC Handbook of Chemistry and Physics, 76th Edition (1995), Section 8-45 to 8-55, "Dissociation Constants of Organic Acids and Bases".

Heoganes Data Sheet for ANCORSTEEL 85 HP, undated.

* cited by examiner

*Primary Examiner* — George Wyszomierski
*Assistant Examiner* — Mark L Shevin
(74) *Attorney, Agent, or Firm* — Rankin, Hill & Clark LLP

(57) ABSTRACT

The present invention provides metal powder compositions for pressed powder metallurgy and methods of forming metal parts using the metal powder compositions. In each embodiment of the invention, the outer surface of primary metal particles in the metal powder composition is chemically cleaned to remove oxides in situ, which provides ideal conditions for achieving near full density metal parts when the metal powder compositions are sintered.

6 Claims, 4 Drawing Sheets

POWDER METALLURGY METHODS AND COMPOSITIONS

BACKGROUND OF INVENTION

1. Field of Invention

Figure 1:
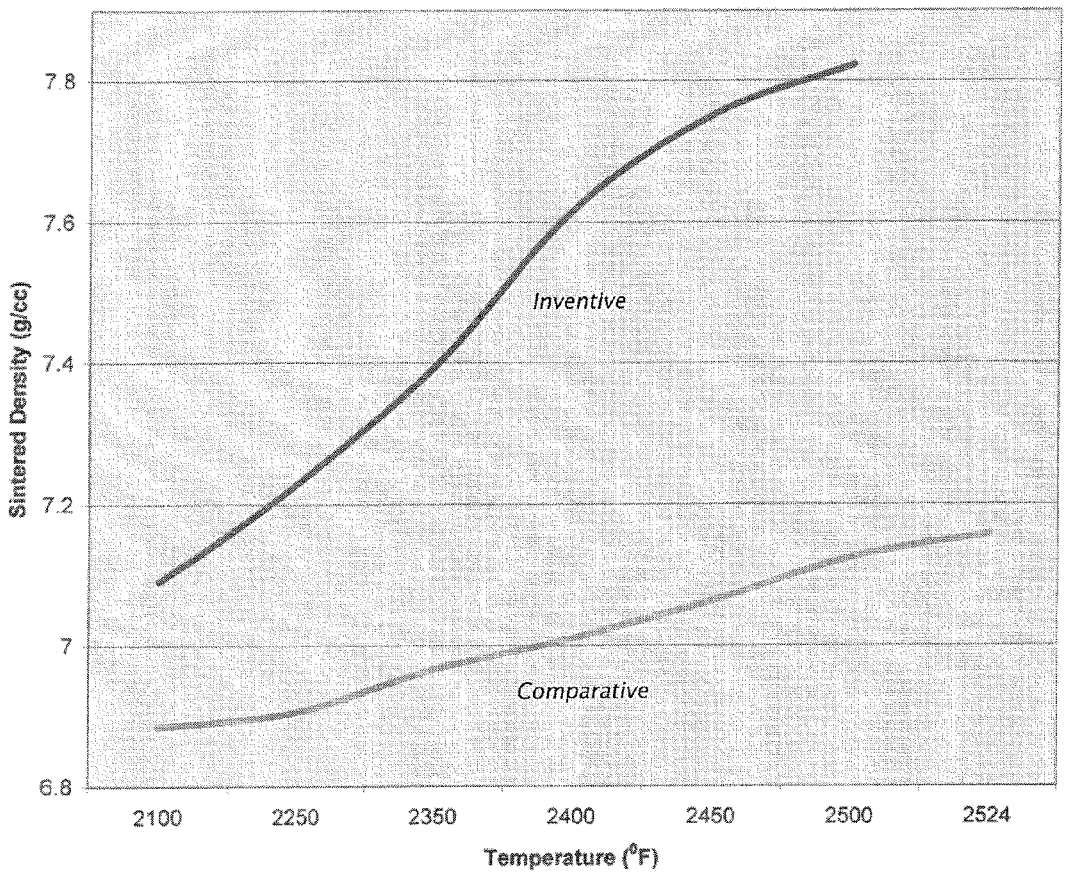

The present invention relates to methods and compositions for use in pressed powder metallurgy.

2. Description of Related Art

In pressed powder metallurgy, a substantially dry metal powder composition is charged into a die cavity of a die press and compressed to form a green compact. Pressing causes the metal powder particles in the metal powder composition to mechanically interlock and form cold-weld bonds that are strong enough to allow the green compact to be handled and further processed. After pressing, the green compact is removed from the die cavity and sintered at a temperature that is below the melting point of the major metallic constituent of the metal powder composition, but sufficiently high enough to strengthen the bond between the metal powder particles, principally through solid-state diffusion. Some metal powder compositions include minor amounts of other metals and/or alloying elements that melt during sintering to facilitate liquid phase sintering of the non-melting major constituent of the metal powder composition. This increases the bonding strength between the major metallic constituent of the metal powder composition and typically increases the final density of the sintered part.

In most pressed powder metallurgy applications, it is necessary to add a lubricant to the dry metal powder composition before it is pressed to form the green compact. The most commonly used lubricants in pressed powder metallurgy are ethylene bis-stearamide wax and zinc stearate, but other lubricants are also sometimes used. Lubricants help the individual metal powder particles flow into all portions of the die cavity, allow for some particle-to-particle realignment during pressing and can serve as release agents that facilitate removal of the green compact from the die cavity after pressing. The least amount of lubricant necessary to obtain good flow and release is used.

Conventionally, the lubricant is removed from the green compact by gradually heating the green compact at a relatively low heating rate (e.g., ~15° F./min) until the lubricant melts, boils and/or decomposes and is completely removed from the pressed part. This "delubing" is typically accomplished during an initial heating or preheating stage at the beginning of the sintering process. This can be accomplished in a batch furnace or in a continuous furnace. In a continuous furnace, the green compact is placed on a conveyor that moves the part slowly into and through a sintering oven. The slow movement of the conveyor allows the temperature of the green compact to increase at a slow rate, allowing the lubricant to melt and then boil and then gas off. Most of the remaining lubricant residue is decomposed and burned out as the temperature of the green compact increases. Some small quantity of the lubricant may diffuse into the base metal and contribute carbon to the final part. The lubricant is completely removed from the green compact at a temperature that is substantially lower than the final sintering temperature. In a batch furnace, the temperature is gradually increased to remove the lubricant prior to sintering that may be programmed to run at different conditions.

To maximize the opportunity for the individual metal particles to bond to each other, it has long been the practice to sinter the green compact at a peak sintering temperature for a significant amount of time, typically on the order of 30 minutes or more. Allowing the part to soak or dwell at the peak sintering temperature for this period of time is believed to increase the likelihood that individual metal particles will bond via solid-state diffusion. The slow movement of the conveyor or the temperature profile in a batch furnace insures that the green compact receives a lengthy soak or dwell time in the hot zone of the sintering oven.

Ideally, the sintered density of a final part would be 100% of the theoretical density of the metallic constituents of the metal powder composition used to form the part. However, the sintered density of parts formed from most conventional metal powder compositions does not approach 100% of theoretical density. Using conventional high carbon or low alloy steel metal powder compositions and pressed powder metallurgy methods, only a sintered density of about 93% to 94% of theoretical density can be achieved in one pressing and sintering. For stainless steels, sintered densities are typically less than 90% of theoretical density for conventional powder metallurgy compositions. Additional processing steps, such as forging and repressing are required to increase the density of the sintered metal part.

BRIEF SUMMARY OF THE INVENTION

The present invention provides metal powder compositions for pressed powder metallurgy and methods of forming metal parts using the metal powder compositions. Four separate invention embodiments are disclosed, but each invention embodiment has a common characteristic, namely that the outer surface of the primary metal particles is chemically cleaned to remove oxides in situ prior to solid state diffusion and liquid phase bonding, which provides ideal conditions for achieving near full density metal parts when the metal powder compositions are sintered. In accordance with the invention, metal parts can be obtained that approach theoretical density in one pressing and sintering operation, without the need for forging or other post-sintering processing steps.

In the first embodiment of the invention, the metal powder composition comprises a blend of primary metal particles (which are sometimes referred to in the art as "base metal" particles), a moderate amount of one or more liquid phase forming materials or precursors thereof and an organics package that is capable of being spread onto an outer surface of the primary metal particles, which comprises an organic lubricant, an organic acid and/or an organic compound that leaves a carbon residue on the outer surface of the primary metal particles subsequent to a delubing heating cycle. The metal powder composition according to the first embodiment of the invention can be pressed, delubed in an inert atmosphere such as nitrogen and then sintered at a rapid heat up rate to produce metal parts that achieve near full density. An example of a metal powder composition according to the first embodiment of the invention is a low alloy steel comprising iron primary metal particles, 2.0% by weight of nickel powder and 0.9% by weight graphite, and an organics package comprising an organic lubricant and an organic acid.

In the second embodiment of the invention, the metal powder composition comprises a blend of primary metal particles, a high amount of one or more liquid phase forming materials or precursors thereof and an organics package that is capable of being spread onto an outer surface of the primary metal particles, which comprises an organic lubricant, an organic acid and/or an organic compound that leaves a carbon residue on the outer surface of the primary metal particles subsequent to a delubing heating cycle. The metal powder composition according to the second embodiment of the invention can be pressed, delubed in an inert atmosphere such as nitrogen and then sintered at conventional sintering rates to produce metal parts that achieve near full density. In the second embodiment of the invention, the presence of a higher amount of liquid phase forming materials obviates the need for sintering at a rapid heat up rate. An example of a metal powder composition according to the second embodiment of the invention is a high-carbon steel comprising iron primary metal particles, 2.0% by weight of graphite, 0.7% by weight of silicon and an organics package comprising 0.4% by weight of an organic lubricant and 0.2% by weight of citric acid.

In the third embodiment of the invention, the metal powder composition comprises a blend of pre-alloyed primary metal particles that have a significant amount of oxides on their outer surface, optionally a low amount of one or more liquid phase forming materials or precursors thereof, and an organics package that is capable of being spread onto an outer surface of the primary metal particles, which comprises an organic lubricant, an organic acid and/or an organic compound that leaves only a small amount of carbon residue on the outer surface of the primary metal particles subsequent to a delubing heating cycle. The metal powder composition according to the third embodiment of the invention can be pressed, delubed in air and then sintered at conventional sintering rates to produce metal parts that achieve near full density. An example of a metal powder composition according to the third embodiment of the invention is a high-alloy steel comprising stainless steel primary metal particles that are solution coated with boron and an organic polymer and then mixed with a lubricant.

In the fourth embodiment of the invention, the metal powder composition comprises a blend of pre-alloyed or admixed primary metal particles that have oxides on their outer surface and an organics package that is capable of being spread onto an outer surface of the primary metal particles, which comprises an organic lubricant, an organic acid and/or an organic compound that leaves only a small amount of carbon residue on the outer surface of the primary metal particles subsequent to a delubing heating cycle. The metal powder composition according to the fourth embodiment of the invention can be pressed, delubed in an inert atmosphere such as nitrogen and sintered at conventional sintering rates to produce metal parts that achieve near full density. Examples of metal powder compositions according to the fourth embodiment of the invention are copper or aluminum alloys comprising copper alloy or aluminum alloy primary metal particles and an organics package that comprises organic acid and a lubricant.

In every embodiment of the invention, the organics package provides for a chemical removal of oxygen from the outer surface of the primary metal particles prior to solid state diffusion and liquid phase bonding, either during the delubing step (i.e., in the case of organic acids) or during the subsequent sintering step (i.e., in the case where the organic compound is converted to a highly reactive carbon residue during delubing). Oxygen is chemically scavenged from the outer surface of the primary metal particles prior to solid state diffusion and liquid phase bonding. When the organics package comprises an organic acid, the organic acid can react with an oxide of a metal on the outer surface of the primary metal particles to form an organic metal salt, which can be reduced to elemental metal during sintering. When the organics package comprises an organic compound that leaves a carbon residue on the outer surface of the primary metal particles subsequent to a delubing heating cycle, the carbon residue can help remove oxygen as carbon dioxide or carbon monoxide gas in the subsequent sintering step prior to solid state diffusion and liquid phase bonding.

The conversion of the metal oxides on the outer surface of the primary metal particles to an organic metal salt during the delubing step, or to carbon dioxide/carbon monoxide during the sintering step, creates a "clean" outer surface on the primary metal particles that is receptive to both solid state diffusion bonding and liquid phase bonding. Plus, the use of low amounts of lubricant allow for close contact between the metal particles, all of which contributes to high sintered densities.

Metal parts formed using the metal powder compositions and methods according to the invention exhibit a substantially higher sintered density than metal parts formed from conventional metal powder compositions. In some embodiments, such higher densities can be reached in less time and at lower energy costs. For example, it is possible to form high-carbon steel or low alloy steel metal parts in one pressing and sintering that have a sintered density that approaches 100% of theoretical density, without subsequent forging and other density increasing post-treatment processes. Subsequent heat treatment of metal parts formed from the metal powder compositions and methods of the invention substantially improve the mechanical properties of the parts, which in some cases are better than can be achieved using non-powder metallurgical processes such as forging and casting.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

BRIEF DESCRIPTION OF THE DRAWING FIGURES

FIGS. 1-4 are graphs showing sintered density as a function of peak sintering temperature for metal powder compositions according to the invention as compared to conventional metal powder compositions.

DETAILED DESCRIPTION OF THE INVENTION

Metal powder compositions according to the present invention comprise a blend of primary metal particles and an organics package that is capable of being spread onto an outer surface of the primary metal particles. The organics package comprises an organic lubricant, an organic acid and/or an organic compound that leaves a carbon residue on the outer surface of the primary metal particles subsequent to a delubing heating cycle. Preferably, the organics package comprises an organic lubricant and one or both of an organic acid and an organic compound that leaves a carbon residue on the outer surface of the primary metal particles subsequent to delubing. At delubing temperatures, at least the organic acid constituent (and possibly the lubricant and/or other organic compound, if present) of the organics package can react with an oxide of a metal on the outer surface of the primary metal particles to form an organic metal salt that decomposes to an elemental metal when the metal powder composition is subsequently sintered. Additionally or alternatively, at delubing temperatures, the organic compound constituent that leaves a carbon residue on the outer surface of the primary metal particles (and possibly the lubricant and/or the organic acid, if present) at least partially decomposes to leave a highly reactive carbon residue on the primary metal particles, which during a subsequent sintering step, can react with surface oxides on the primary metal particles to form carbon dioxide and/or carbon monoxide, which are removed as gases prior to solid state diffusion and liquid phase bonding.

Throughout the instant specification and in the accompanying claims, the term "primary metal particles" refers to the principal metal powder component of the metal powder composition by weight. The primary metal particles can comprise a single metallic element (e.g., iron), or can comprise pre-alloyed particles (e.g., low-alloy steels and stainless steels), agglomerations or blends of two or more metallic elements. Suitable metallic elements include, for example, iron, copper, chromium, aluminum, nickel, cobalt, manganese, niobium, titanium, molybdenum, tin and tungsten. Iron is a particularly preferred metallic element for use in metal powder compositions according to the invention because it is the major constituent of steels. It will be appreciated that metal powder compositions according to the invention can include other additive elements, such as bismuth, vanadium and manganese (typically in the form of manganese sulfide) for example, and other conventional additives.

The primary metal particles used in powder metal compositions according to the invention tend to have surfaces that are oxidized, typically as a result of contact with oxygen in the atmosphere or with water vapor. Primary metal particles comprising iron, which are frequently used in pressed powder metallurgy to form steel parts, have surfaces that are oxidized to form iron oxide. Applicants believe that metal oxides on the surface of primary metal particles may interfere with solid-state diffusion bonding between such particles during sintering. The metal oxides on the surface of the primary metal particles may also inhibit the solid state diffusion and formation of liquid phase alloys, which can be used to solder, weld or otherwise bind the individual metal particles together.

Applicants have found that when the metal powder compositions according to the invention are delubed (which is also sometimes referred to in the art as "debound") under controlled conditions, certain chemical reactions can occur, which cause the green compact to achieve a sintered density that approaches theoretical density. The potential first action occurs when the organics package comprises an organic acid and/or an organic compound having acid-functional groups. The acid is available to react with metal oxides on the outer surface of the primary metal particles to form a metal salt residue. The second potential action occurs as a result of the delubing temperatures and conditions, which causes the organic material on the outer surface of the primary metal particles to be converted into highly reactive carbon residue, which is available to react with oxides on the outer surface of the primary metal particles and form carbon monoxide or carbon dioxide gas during a subsequent sintering step. It will be appreciated that depending on the composition of the organics package and the composition of the metal powder composition, either or both of the actions can occur. Both mechanisms remove metal oxides from the outer surface of the primary metal particles at temperatures well below where solid state diffusion and liquid phase formation occurs. The carbon residue has a favorable molar weight ratio to remove oxides on the metal surface (e.g., the carbon to oxygen molar weight ratio is 2.66 to 1 for carbon dioxide, and 1.33 to 1 for carbon monoxide) during heat up. This results in a complete or partial removal of oxides and significantly cleaner surfaces that allow the metal and liquid phase formers to consolidate to achieve the near full density compact.

A variety of organic acids are known to react with metal oxides to produce organic metal salts. For example, acetic acid will react with iron oxide to form ferrous acetate. Similarly, citric acid will react with iron oxide to form ferrous citrate. Lactic acid will react with iron oxide to ferrous lactate. And, malic acid, tartaric acid, oxalic acid, oleic acid, and stearic acid will react with iron oxide to form ferric malate, ferrous tartrate, ferrous oxalate, ferric oleate and ferrous stearate, respectively.

Organic acids suitable for use in the invention are those which are strong enough to react with metal oxides on the surface of the primary metal particles to produce metal salts, and which are compatible with the mixing, filling and compaction and sintering steps of the pressed powder metallurgy process. Preferably, the organic acid or acids used in the invention do not leave undesirable residues or by-products when decomposed during delubing and sintering. Accordingly, organic acids that are free of, or contain very little, sulfur, nitrogen, phosphorous and halogens are preferred.

Fatty acids are particularly suitable organic acids for use in the invention. A non-exhaustive list of fatty acids is set forth in Section 7-28 ("Properties of Selected Fatty Acids") of the CRC Handbook of Chemistry and Physics, 76th Edition (1995), which is hereby incorporated by reference. It will be appreciated that other organic acids can also be used. Many organic acids are listed in Section 8-45 to 8-55 ("Dissociation Constants of Organic Acids and Bases") of the CRC Handbook of Chemistry and Physics, 76th Edition (1995), which is also hereby incorporated by reference. The organic acids identified in that list that are compatible with pressed powder metallurgy and which are free of, or contain very little, sulfur, nitrogen, phosphorous and halogens can be used.

Citric acid is the presently most preferred organic acid for use with metal powder compositions for low alloy steel and carbon steels as well as stainless steel, copper and aluminum. Other particularly useful organic acids include acids that have a pKA value low enough to react with metal oxides and which are solids at press conditions (typically ~140° F. and higher). Examples of suitable alternative acids to citric acid include, for example, oxalic acid, tartaric acid, malic acid and low-melting acids that are partially solublized in higher melting acids or other organic materials that decompose into constituents that are similar to citric acid or the other acids identified above. It will be appreciated that other organic compounds, particularly low molecular polymers (e.g., Fischer-Tropsch waxes and polymers based on polyethylene) may be used as constituents of the organics package.

The composition and amount of the organics package present in the metal powder composition will depend on the amount of metal oxide to be removed from the primary metal particles, the total volume of space between the primary metal particles (and any liquid phase forming materials present in the metal powder composition) to be occupied by the organics package upon compaction, and the ability of the constituents of the organics package to remove the metal oxides during the delubing/sintering cycle(s). Loadings from about 0.1% by weight to about 4% by weight are typically sufficient. When the organics package comprises an organic acid, it is preferable for a stoichiometric amount of the organic acid to be used relative to the oxides on the surface of the primary metal particles, plus an excess of about 10 mole percent, if press conditions allow for it in terms of total volume.

To insure adequate distribution of the organics package in the metal powder composition, it is preferable that the organics package be micronized to an average particle size of about 30 μm or less (e.g., via milling). When organic acids are used neat (i.e., not blended with other materials), it is preferable for the organic acids to be mirconized close in time prior to use so that the micronized particles do not have an opportunity to degrade upon exposure to atmospheric moisture.

In order to determine the amount of components that may be included in the metal powder composition in addition to the primary metal particles, the practical achievable green density of the primary metal particles present in the powder metal composition at a given pressure must be known. The practical achievable green density can be determined by pressing samples of the primary metal particles mixed with 0.35% by weight of a solid-to-liquid phase-changing lubricant system such as APEX Superlube PS1000b available from Apex Advanced Technologies of Cleveland, Ohio at predetermined pressures. No other components are pressed with the primary metal particles and the lubricant to make this determination, but a conventional die wall lubricant must be applied to the mold cavity in order to eject the pressed samples. The primary metal particles and lubricant mixture is pressed at 30, 40, 50 and 60 TSI, and the green density of the resulting pressed samples is measured. The green density data is then preferably recorded in a database or spreadsheet so that the practical achievable green density for the particular primary metal particles need not be repeated for future parts made from such material.

Once the practical achievable green density of the primary metal particles present in the powder metal composition at a given press pressure is known, the theoretical percentage of maximum volume occupied by the primary metal particles in the green compact at that pressure can be calculated as a function of the specific gravity of the base metal. To make this calculation, the practical achievable green density of the sample at the desired pressure is divided by the specific gravity of the base metal, and the result is then multiplied by one hundred (100) to obtain a value that represents the theoretical percentage of maximum volume occupied by the pressed primary metal particles. To determine the theoretical percentage of void space remaining in the green compact pressed at that pressure, one would simply subtract the theoretical percentage of maximum volume occupied by the pressed base metal particles from 100 percent.

Once the theoretical percentage of maximum volume occupied by the pressed primary metal particles at the desired pressure is known, an accounting must be made for the theoretical percentage of maximum volume occupied by the other components present in the powder metal composition (e.g., the liquid phase formers, organic compound, lubricant and any optional additives). The theoretical percentage of maximum volume occupied by the other components present in the powder metal composition is calculated by determining the weight percent fraction of such components in the powder metal composition, and then by determining the theoretical percentage of maximum volume occupied by such components based on the specific gravity of such components relative to the specific gravity of the primary metal particles. The sum of the theoretical percentage of maximum volume occupied by the pressed primary metal particles at the desired pressure and the theoretical percentage of maximum volume occupied by the other components present in the powder metal composition will preferably be about 99% to about 99.5% of maximum volume.

If the organic compound is an organic acid, or has acid functionality, as the green compact is heated in an inert atmosphere (e.g., nitrogen and/or argon) during delubing, the organic acid present in the metal powder compositions will react with the metal oxides on the surface of the primary metal particles to form organic metal salts. Without being bound to a particularly theory, applicants believe that any one or more of three distinct reaction mechanisms may occur during the heating of the green compact, which facilitate the removal of the metal oxide layer from the surface of the primary metal particles: melt fusion; ionic; and/or vapor. In the melt fusion reaction mechanism, the organic acid would melt and boil on the surface of the primary metal particles, reaching temperatures that allow for a direct neutralization reaction. In the ionic reaction mechanism, the organic acid would partially dissolve in residual water that is bonded or adhered to the surface of the primary metal particles forming a hot ionic acid that dissolves the metal oxide as the temperature rises. In the vapor reaction mechanism, the organic acid would become volatile and scavenges the metal oxide layer as it escapes from the green compact.

Delubing is preferably conducted in an inert atmosphere, such as nitrogen or argon, because an inert atmosphere allows the constituents of the organics package and the surface of the primary metal particles to react with each other. A hydrogen atmosphere could cleave the organics and/or interfere with the oxygen-scavenging/carbon residue producing reactions. And, delubing in a vacuum would promote vaporization of the organics, which again would interfere with the desired reactions.

Although the exact mechanism of the reaction between the organic acid and the metal oxide on the surface of the primary metal particles is not definitively known at present, applicants believe that the organic acid effectively removes all or some part of the metal oxides from the surface of the primary metal particles. The "cleaned" surfaces of adjacent primary metal particles are in contact with each other, which allows for better necking in the solid phase, because there is less hindrance or interference to diffusion bonding caused by the presence of a metal oxide at the interface between the particles.

If the organic compound does not include acid functionality, the organic compound must decompose to form a carbon residue on the outer surface of the primary metal particles. The carbon residue can react with any oxygen on the surface of the metal particles during sintering (before liquid phase bonding) and thereby remove the oxygen in the form of gaseous carbon dioxide and/or carbon monoxide. Again, the outer surface of the primary metal particles is cleaned of oxygen, making it more susceptible to solid state diffusion and liquid phase bonding during sintering.

In the first embodiment of the invention, the metal powder composition comprises a blend of primary metal particles containing of iron and optionally less than 8% by weight of alloying elements (i.e., low alloy steel), a moderate amount of one or more liquid phase forming materials or precursors thereof and an organics package that is capable of being spread onto an outer surface of the primary metal particles, which comprises an organic lubricant, an organic acid and/or an organic compound that leaves a carbon residue on the outer surface of the primary metal particles subsequent to delubing. Throughout the instant specification and in the accompanying claims, the term "liquid phase forming materials" refers to metallic alloys that, when present between adjacent primary metal particles in a liquid (molten) state during sintering, assist in forming a liquid phase bond (e.g. solder/weld-type bonds) between the primary metal particles. Liquid phase forming materials are separate and distinct from the primary metal particles, and are blended therewith, usually in the form or precursors that form a liquid phase with the primary metal particles during sintering, to form a substantially homogeneous composition.

Iron is the predominant metallic constituent of low alloy dry powder steel metal compositions, and the presence of carbon, nickel, manganese, silicon, phosphorous, boron, chromium, cobalt, vanadium and/or molybdenum on the surface of the oxide-free metal particles can lead to the liquid phase forming materials such as, for example, Fe—C—Mn, Fe—C, Fe—C—Si, Fe—Mn, Fe—P, Fe—S, Co—C, Mo—C, Mn—C, Ni—C, Fe—B and Fe—Cr. Precursors to liquid phase forming materials thus include graphite, ferro phosphorous, copper phosphorous, boron, manganese, silicon, phosphorous, boron, chromium, cobalt, nickel and/or molybdenum. It will be appreciated that other additives, such as manganese sulphide, vanadium, and bismuth for example, can be included in the compositions to improve workability, machine-ability and mechanical properties.

As noted, a moderate amount of liquid phase formers or precursors thereof are present in the first embodiment of the metal powder composition according to the invention. Throughout the instant specification and in the appended claims, the term "moderate" amount means an amount of liquid phase formers that, in a rapid heat up rate during sintering, can form a liquid phase between the primary metal particles to promote bonding, but which amount is insufficient to promote liquid phase bonding if a conventional heat up rate was employed (i.e., the liquid phase formers would diffuse into the primary metal particles and be depleted during a conventional heat up cycle and thus not be available to form liquid phase bonds). In the first embodiment of the invention, the sum of alloying elements in the primary metal particles and liquid phase formers should not exceed 8% by weight of the total sintered composition.

In the first embodiment of the invention, the organics package preferably comprises both an organic acid and a lubricant, which are mixed together (e.g., to create a masterbatch). The liquid phase formers or precursors can also be mixed with the organics package prior to distribution with the primary metal particles. Conventional lubricants such as ethylene bis-stearamide wax and zinc stearate can be used, but the lubricant described in U.S. Pat. No. 6,679,935, the entire text of which is hereby incorporated by reference, is most preferred. Such a lubricant transforms from a solid to a liquid due to shear in the press, spreads and makes a uniform coating of lubricant, liquid phase forming materials and/or precursors and organic acid on the surface of the primary metal particles. Furthermore, it is effective at low loadings, and thus allows the metal particles to be rearranged during pressing such that they are very close together without taking up much volume, which is believed to contribute to the improved sintered and green densities noted in the invention. The lubricant, due to its liquid nature, becomes less viscous as the temperature rises, and the molten lubricant can serve as an effective vehicle or solvent for the organic acid and the liquid phase forming materials and/or precursors thereof. It will be appreciated that some organic acids, particularly longer chain fatty acids, can serve as both a lubricant and a compound that assists in the removal of metal oxides from the surface of the metal powder particles.

The iron oxide content of most commercial low alloy steel metal powder compositions for pressed powder metallurgy ranges from 0.05% to 0.5% by weight as oxygen. Metal powders having the lowest oxygen content provide the best compressibility and best final properties in conventional metal powder compositions, but these low-oxygen content metal powders are generally more expensive. Use of an organics package according to the present invention allows for the removal of the oxygen from standard grade low alloy steel metal particles, which is present as iron oxide. When the organics package comprises an organic acid, the organic acid reacts with the iron oxide or other metals to form an organic iron salt, which decomposes during sintering to form very finely divided iron metal or other base starting metals, which can serve to promote solid state sintering and localized liquid phase sintering, or iron carbide, which can be a component of the low alloy or carbon steel part. Thus, use of an organic acid provides two distinct benefits: metal particles having outer surfaces that have all or most of the metal oxides removed in situ, which enhances the efficiency of both solid state and liquid phase sintering; and a by-product from the decomposition of the iron salt, which also enhances the solid state or liquid phase sintering.

Applicants have discovered that it is critical that delubed green compact formed from a powder metal composition according to the first embodiment of the invention be heated to peak sintering temperature in a reducing atmosphere or inert atmosphere at a rate of about 60° F./min or more in order to obtain a metal part having a higher sintered density than would otherwise be obtained using a conventional metal powder composition. Applicants believe that the delubing procedure removes all or most of the oxide layer from the surface of the metal particles at the last possible moment before sintering, which promotes solid-state diffusion and liquid phase sintering. Heating at a rate lower than 60° F./min does not appear to provide any improvement in sintered density.

Applicants theorize that once the metal oxides have been removed from the surface of the primary metal particles, the liquid phase forming material present at or on the outer surface of the metal particles becomes highly receptive to solid state diffusion. If the heating rate is slow, diffusion occurs over an extended period of time contemporaneous with the relatively slow heating rate, allowing the liquid phase forming material present at or on the outer surface of the particles time to diffuse into the primary metal particles, which depletes the amount of liquid phase forming material available on the surface of the particles and thus no liquid phase soldering, welding or bonding occurs between the particles. In essence, a slow heating rate assures that bonding is accomplished predominantly or entirely by solid state diffusion, and not by liquid phase bonding. Use of a fast heat up rate, on the other hand, reduces the time the liquid phase forming materials at or on the outer surface of the cleaned particles have to diffuse into the primary metal particles, and thereby maintains sufficient amounts of liquid phase forming material on the outer surface of the primary metal particles to promote liquid phase bonding between the particles during sintering. Liquid phase bonding is similar to soldering or welding, and leads to substantial improvements in the final density of the sintered parts. Thus, the rapid heating rate is necessary to provide sufficient time for liquid phase forming materials to form liquid-type bonding between the primary metal particles in metal powder compositions according to the first embodiment of the invention. The time period during which the rapid heating occurs may vary according to the particular heating process and equipment being used, but is typically accomplished within about ten minutes or less. High oven temperatures can be used (i.e., oven temperatures of as high as about 2,650° F., which is in excess of the melting temperature of the primary metal particles) so long as the metal part is not allowed to reach a temperature above the melting temperature of the primary metal particles. Use of sintering temperatures below the melting temperature of the primary metal particles can allow for minimum distortion, provided the heating rate is rapid. Sintering is typically conducted in a non-oxidizing, preferably reducing, atmosphere such as that which comprises a blend of hydrogen and nitrogen, or in endothermic (e.g. $CO—H_2—N_2$) or inert atmospheres (e.g., Ar). Sintering should be accomplished on a smooth, porous support, which allows for degassing of the part and shrinkage without damaging the part.

Thus, the first method of forming a low-alloy steel metal part according to the invention comprises: (i) providing a metal powder composition comprising a blend of primary metal particles containing iron and optionally up to 8% by weight of one or more alloying elements, a moderate amount of one or more liquid phase forming materials or precursors thereof and an organics package that is capable of being spread onto an outer surface of the primary metal particles during a subsequent compacting step, wherein the organics package comprises an organic lubricant, an organic acid and/or an organic compound that leaves a carbon residue on the outer surface of the primary metal particles subsequent to delubing; (ii) compacting the metal powder composition within a die cavity to form a green compact thereby spreading the organics package onto an outer surface of the primary metal particles; (iii) delubing the green compact in a non-oxidizing atmosphere to cause constituents of the organics package to react with an oxide of a metal on the outer surface of the primary metal particles to form an organic metal salt and/or at least partially decompose to leave a carbon residue on the outer surface of the primary metal particles; and (iv) heating the delubed green compact to a peak sintering temperature at a heat up rate of 60° F./min or higher in a non-oxidizing atmosphere to form the low-alloy steel part. The removal of the oxides on the surface of the primary metal particles during the delubing step (or in the sintering step in the case where the oxygen is removed via a reaction with carbon residue) creates a "clean" surface on the primary metal particles that is receptive to both liquid phase bonding and subsequent diffusion bonding. The rapid heating rate during the sintering step ensures that the liquid phase formers have adequate time to create liquid phase bonds between the primary metal particles before the constituents of the liquid phase diffuse into the particles. With more efficient oxide reduction or removal, the leaner compositions reach higher densities. These leaner compositions have a smaller time window to react, which is made available by having an earlier removal of oxides.

In a second embodiment of the invention, the metal powder composition preferably comprises a blend of primary metal particles consisting essentially of iron, a high amount of one or more liquid phase forming materials or precursors thereof containing elements selected from the group consisting of carbon, silicon, manganese and phosphorous and an organics package that is capable of being spread onto an outer surface of the primary metal particles, which comprises an organic lubricant, an organic acid and/or an organic compound that leaves a carbon residue on the outer surface of the primary metal particles subsequent to a delubing heating cycle. As noted, the liquid phase forming materials or precursors thereof in this embodiment are preferably one or more selected from the group consisting of carbon, silicon, manganese, and phosphorous, which are typical components of a high carbon steel or malleable iron. Throughout the instant specification and in the appended claims, the term "high" amount means an amount of liquid phase formers that can form a liquid phase between the primary metal particles to promote bonding when a conventional heat up rate is employed. Unlike the first embodiment of the invention, sufficient liquid phase forming material remains on the surface of the primary metal particles that a rapid heat up is not necessary. There is sufficient liquid phase forming material on the cleaned (i.e., oxygen scavenged) outer surfaces of the primary metal particles to promote liquid phase bonding between particles at conventional heat up rates, because of the amount or the saturation of the alloying materials in the primary metal particles. The metal powder composition according to the second embodiment of the invention can be pressed, delubed in an inert atmosphere such as nitrogen and then sintered at conventional sintering rates to produce metal parts that achieve near full density.

Thus, the second method of forming a high-carbon steel metal part (i.e., the metal part comprises >0.5% by weight carbon) according to the invention comprises: (i) providing a metal powder composition comprising a blend of primary metal particles consisting essentially of iron, a high amount of one or more liquid phase forming materials or precursors thereof containing elements selected from the group consisting of carbon, silicon, manganese and phosphorous and an organics package that is capable of being spread onto an outer surface of the primary metal particles during a subsequent compacting step, wherein the organics package comprises an organic lubricant, an organic acid and/or an organic compound that leaves a carbon residue on the outer surface of the primary metal particles subsequent to delubing; (ii) compacting the metal powder composition within a die cavity to form a green compact thereby spreading the organics package onto an outer surface of the primary metal particles; (iii) delubing the green compact in a non-oxidizing atmosphere to cause constituents of the organics package to react with an oxide of a metal on the outer surface of the primary metal particles to form an organic metal salt and/or at least partially decompose to leave a carbon residue on the outer surface of the primary metal particles; and (iv) heating the delubed green compact to a peak sintering temperature in a non-oxidizing atmosphere to form a metal part comprising >0.5% by weight carbon.

In the third embodiment of the invention, the metal powder composition comprises a blend of: (i) primary metal particles comprising iron which have been either pre-alloyed with >8% by weight of one or more alloying elements and/or ad-mixed with >8% by weight of particles of alloying elements and have a significant amount of oxides on their outer surface; (ii) optionally, a low amount of one or more liquid phase forming materials or precursors thereof; and (iii) an organics package that is capable of being spread onto an outer surface of the primary metal particles, which comprises an organic lubricant, an organic acid and/or an organic compound that leaves only a small amount of carbon residue on the outer surface of the primary metal particles subsequent to a delubing heating cycle. Throughout the instant specification and in the appended claims, the term "low" amount means an amount of liquid phase formers that can be tolerated by the primary metal particles without disrupting the properties. As in the case of the second embodiment of the invention, a rapid heat up is not necessary during sintering. The metal powder composition according to the third embodiment of the invention can be pressed, delubed in air and then sintered at conventional sintering rates to produce metal parts that achieve near full density.

Boron is a preferred liquid phase former for pre-alloyed primary metal particles comprising stainless steel. In the prior art, boron has been used as an addition to the melt before the primary metal has been atomized. The presence of boron in the primary metal allows for higher sintered densities to be achieved, but it has an undesirable effect in that it makes it difficult to control the dimensions of the part during sintering (i.e., unpredictable and variable shrinkage). In accordance with the present invention, it is possible to distribute boron only on the surface of the primary metal particles in a homogeneous manner by mixing the boron as a solution with a water soluble polymer such as, for example, xanthan gum. The water soluble polymer, once dried, holds the boron source in place and does not allow it to crystallize or segregate. When the water soluble polymer is a high molecular weight water soluble polymer such as xanthan gum, for example, the delubing can be accomplished in an air atmosphere up to a temperature of about 775° F. because stable oxides do not form below that temperature. Delubing in air is necessary to achieve overall low carbon levels, which are desirable for best corrosion resistance in stainless steel. Delubing above 775° F. should be conducted in a hydrogen atmosphere to complete the decomposition of the high molecular weight water soluble polymer and thus form a carbon residue on the primary metal particles, which is thus available to reduce the boron source, which is $B_2O_3$ after drying, to allow finely divided elemental boron on the surface of the of the stainless steel to act as a liquid phase former on the outer surface of the primary metal particles during sintering. The water soluble polymer is also thought to help in the removal of oxides on the metal surface due to the carbon residue present on the surface of the metal particle, therefore allowing better consolidation in the sintering phase.

Thus, the third method of forming a metal part according to the invention comprises: (i) providing a metal powder composition comprising a blend of primary metal particles comprising iron, wherein the primary metal particles are either pre-alloyed with >8% by weight of one or more alloying elements and/or are ad-mixed with >8% by weight of particles of alloying elements, and wherein the primary metal particles have a significant amount of oxides on their outer surface, optionally a low amount of one or more liquid phase forming materials or precursors thereof, and an organics package that is capable of being spread onto an outer surface of the primary metal particles during a subsequent compacting step, wherein the organics package comprises an organic lubricant, an organic acid and/or an organic compound that leaves a carbon residue on the outer surface of the primary metal particles subsequent to delubing; (ii) compacting the metal powder composition within a die cavity to form a green compact thereby spreading the organics package onto an outer surface of the primary metal particles; (iii) delubing the green compact to cause constituents of the organics package to react with an oxide of a metal on the outer surface of the primary metal particles to form an organic metal salt and/or at least partially decompose to leave a carbon residue on the outer surface of the primary metal particles; and (iv) heating the delubed green compact to a peak sintering temperature in a non-oxidizing atmosphere to form the metal part.

In the fourth embodiment of the invention, the metal powder composition comprises a blend of pre-alloyed primary metal particles (or non-alloyed base metal particles that have been ad-mixed with particles of alloying elements or alloys) that have oxides on their outer surface and an organics package that is capable of being spread onto an outer surface of the primary metal particles, which comprises an organic lubricant, an organic acid and/or an organic compound that leaves only a small amount of carbon residue on the outer surface of the primary metal particles subsequent to a delubing heating cycle. The metal powder composition according to the fourth embodiment of the invention can be pressed, delubed in an inert atmosphere such as nitrogen and sintered at conventional sintering rates to produce metal parts that achieve near full density. An example of a metal powder composition according to the fourth embodiment of the invention comprises copper or aluminum alloy primary metal particles and an organics package that comprises organic acid and a lubricant.

At delubing temperatures, the constituents of the organics package can react with oxides of one or more metals on the outer surface of the primary metal particles to form organic metal salts and/or at least partially decompose to leave a carbon residue on the outer surface o the primary metal particles. Preferably, the primary metal particles comprise copper or aluminum, which may be alloyed with conventional alloying elements. No liquid phase forming materials or precursors thereof need be added to the composition according to the fourth embodiment of the invention. However, due to the low viscosity of the metal in the primary metal particles, the particles tend to fuse together, likely through solid state diffusion alone, and form high density parts upon sintering. The absence of an oxide layer, which is stripped during the delubing step, yields primary metal particles having very "clean" (i.e., oxide-free or having very low amounts of oxide residues) surfaces, which are capable of bonding and fusing together without the need for liquid phase forming materials or precursors thereof.

Thus, the fourth method of forming a metal part according to the invention comprises: (i) providing a metal powder composition comprising a blend of pre-alloyed primary metal particles (or non-alloyed base metal particles that have been ad-mixed with particles of alloying elements or alloys) that have oxides on their outer surface and an organics package and an organics package that is capable of being spread onto an outer surface of the primary metal particles during a subsequent compacting step, wherein the organics package comprises an organic lubricant, an organic acid and/or an organic compound that leaves a carbon residue on the outer surface of the primary metal particles subsequent to delubing; (ii) compacting the metal powder composition within a die cavity to form a green compact, wherein subsequent to compaction the organic compound is spread onto an outer surface of the primary metal particles; (iii) delubing the green compact in a non-oxidizing atmosphere to cause the organic compound to: react with an oxide of a metal on the outer surface of the primary metal particles to form an organic metal salt, and/or at least partially decompose the organic compound to leave a carbon residue on the primary metal particles; and (iv) heating the delubed green compact to a peak sintering temperature in a non-oxidizing atmosphere to form the metal part. The removal of oxygen from the surface of the primary metal particles during the delubing step creates a "clean" surface on the primary metal particles that is receptive to both liquid phase bonding and subsequent diffusion bonding. Because no liquid phase forming materials or precursors thereof are present in the composition, the heating rate during sintering is not critical.

Metal parts formed using the metal powder compositions and methods according to the invention exhibit a substantially higher sintered density than metal parts formed from metal powder compositions and methods, and in some embodiments such higher densities can be reached in less time and at lower energy costs. For example, it is possible to form carbon steel or low alloy steel metal parts that have a sintered density that approaches 100% of theoretical density. Steels having sintered densities of 96% of theoretical or higher, including 97%, 98%, 99% and 99.5%, are achievable in one pressing and sintering operation without post-sintering forging.

Copper parts can also be formed in accordance with the invention, which have sintered densities approaching 100% of theoretical density. Subsequent heat treatment of metal parts formed from the metal powder compositions and methods of the invention substantially improve the mechanical properties of the parts, which in some cases are better than can be achieved using non-powder metallurgical processes such as forging and casting.

The following examples are intended only to illustrate the invention and should not be construed as imposing limitations upon the claims.

Example 1

A Stock Powder Metallurgy Composition ("Stock P/M") was prepared by dry mixing the components set forth in Table 1 below:

TABLE 1

| Component | Weight Percent |
|---|---|
| ANCORSTEEL 85 HP* | 97.00% |
| UT-3PM** | 2.00% |
| Graphite Powder | 0.65% |
| SUPERLUBE PS1000-B*** | 0.35% |

*ANCORSTEEL 85 HP is a water atomized, pre-alloyed steel powder (approximate chemical composition in weight percent: ~98.93% Fe; 0.86% Mo; 0.12% Mn; 0.08% O; and <0.1% C) available from Hoeganaes Corporation of Cinnaminson, New Jersey.
**UT-3PM is a high-purity nickel powder for pressed powder metallurgy applications available from Norilsk Nickel of Moscow, Russia.
***SUPERLUBE PS1000-B is a pressed powder metallurgy lubricant capable of transforming from a solid to a liquid due to shear from Apex Advanced Technologies of Cleveland, Ohio.

Example 2

Test bars were formed using the Stock P/M formed in Example 1. In Sample 1, the test bar was formed solely out of the Stock P/M formed in Example 1. In Samples 2 and 3, the test bars were formed by blending the Stock P/M with citric acid at a 0.2% by weight loading and a 0.4% by weight loading, respectively. Each test bar was formed using a 50 tsi (tons per square inch) Tinius Olsen hydraulic press. Each test bar had the following dimensions: ½" wide×1¼" long×¼" thick.

The green density of the pressed test bars was measured in accordance with the procedures set forth in MPIF Standard 45 and ASTM B331-95 (2002). The green test bars were delubed at normal conditions and were sintered in a continuous furnace at a heat up rate of 133° F./min in the hot zone to a temperature of 2,480° F. in an atmosphere consisting of 25% $H_2$ and 75% $N_2$. The density of the green and sintered test bars is reported in Table 2 below:

TABLE 2

| Sample | Stock P/M | Citric Acid | Green Density | Sintered Density |
|---|---|---|---|---|
| 1 | 100% | 0% | 7.24 g/cm$^3$ | 7.32 g/cm$^3$ |
| 2 | 99.8% | 0.2% | 7.15 g/cm$^3$ | 7.81 g/cm$^3$ |
| 3 | 99.6% | 0.4% | 7.11 g/cm$^3$ | 7.83 g/cm$^3$ |

The data reported in Table 2 shows that at a rapid heat up rate (>60° F./min), the presence of a small amount of citric acid in the Stock P/M blend results in a substantial improvement in sintered density. Specifically, the data in Table 2 shows that blending 0.4% by weight of citric acid with the Stock P/M coupled with a heat up rate of 133° F./min increases the sintered density of the test bars from 7.32 g/cm$^3$ to 7.83 g/cm$^3$, which is an improvement from 93.25% to 99.75% of theoretical density.

Example 3

Test bars were formed using the same Stock P/M formed in Example 1 using the same procedures as set forth in Example 2. The green test bars were delubed at normal conditions, sintered in a continuous furnace at a heat up rate of 50° F./min in the hot zone to a temperature of 2,480° F. in an atmosphere consisting of 25% $H_2$ and 75% $N_2$. The density of the green and sintered test bars is reported in Table 3 below:

TABLE 3

| Sample | Stock P/M | Citric Acid | Green Density | Sintered Density |
|---|---|---|---|---|
| 4 | 100% | 0% | 7.29 g/cm$^3$ | 7.42 g/cm$^3$ |
| 5 | 99.6% | 0.4% | 7.21 g/cm$^3$ | 7.35 g/cm$^3$ |
| 6 | 99.2% | 0.8% | 7.10 g/cm$^3$ | 7.23 g/cm$^3$ |

The data reported in Table 3 shows that the presence of small amounts of citric acid in the Stock P/M blend does not result in any improvement in sintered density when the heat up rate is below 60° F./min. Specifically, the sintered density of the test bars decreased with the addition of citric acid at a heat up rate of 50° F./min due to lower green density to start. Typically there is a direct correlation between green densities and sintered, the lower it starts the lower it goes. The failure to achieve improvements in sintered density is attributed to the solid-state diffusion of the liquid phase forming graphite and nickel into the steel primary metal particles during the conventional slow heat up rate employed.

Example 4

Test bars were formed using the same Stock P/M formed in Example 1 using the same procedures as set forth in Example 2. The green test bars were delubed at normal conditions, sintered in a continuous furnace at a heat up rate of 15° F./min in the hot zone to a temperature of 2,460° F. in an atmosphere consisting of 25% $H_2$ and 75% $N_2$. The density of the green and sintered test bars is reported in Table 4 below:

TABLE 4

| Sample | Stock P/M | Citric Acid | Green Density | Sintered Density |
|---|---|---|---|---|
| 7 | 100% | 0% | 7.29 g/cm$^3$ | 7.43 g/cm$^3$ |
| 8 | 99.6% | 0.4% | 7.27 g/cm$^3$ | 7.46 g/cm$^3$ |
| 9 | 99.2% | 0.8% | 7.11 g/cm$^3$ | 7.45 g/cm$^3$ |

The data reported in Table 4 shows that the presence of small amounts of citric acid in the Stock P/M blend had no appreciable effect on the sintered density at conventional powder metallurgy heat up rates. Specifically, the sintered density of the test bars was relatively constant with the addition of citric acid at a heat up rate of 15° F./min.

Example 5

The Stock P/M Composition from Example 1 was used to form test bars as described in Example 2. One set of test bar samples were pressed solely out of the Stock P/M Composition. A second set of test bar samples were pressed out of the Stock P/M Composition mixed with an additional 0.4% by weight of citric acid. All of the test bars were delubed in a continuous furnace in an inert atmosphere consisting of 100% nitrogen at a peak temperature below about 410° F. at a heating rate of about 16° F. per minute. The test bars were then allowed to cool to ambient temperature (~72° F.) and later were placed in a microwave furnace under a reducing atmosphere and heated for 2.5 minutes. The test bars that did not include citric acid reached a sintered density of 7.65 g/cm$^3$ at 1356° F., whereas the test bars that did include citric acid reached a sintered density of 7.81 g/cm$^3$ at the same temperature. Theoretical density would be considered to be ~7.82-7.84 g/cm$^3$. The temperature noted is a reference temperature only. The actual part temperature may have been higher at the peak of heating. Rapid heating of the test bars that included an organic acid resulted in significantly higher sintered density than the test bars that did not include an organic acid.

Example 6

A powder metal grade of powdered copper (ACuPowder Grade 165: ~99.5% purity—obtained from ACuPowder International LLC of Union, NewJersey) was mixed with 0.35% by weight of Apex Lubricant PS1000b and 0.1% by weight lithium stearate and pressed into test bars as described in Example 2. Lithium stearate is generally known and regarded in the art as an additive that helps copper achieve higher density. A second set of test bars were pressed out of a composition comprising the same powdered copper, 0.35% by weight of Apex Lubricant (PS1000b) and 0.4% by weight citric acid. All of the test bars were then delubed and sintered in one operation in a batch furnace at 15° F. degrees per minute in 100% hydrogen up to 1930° F. with a 30 minute hold-at temperature. Rapid heating after the delube step was not required to obtain higher sintered density because there were no alloying/liquid phase forming elements present in the composition. The test bars that did not include citric acid reached a sintered density of 8.05 g/cm$^3$, whereas the test bars that did include citric acid reached a sintered density of 8.95 g/cm$^3$. Theoretical density ranges from 8.92 to 8.96. By removal of the surface oxides alone the density achieved 100% theoretical.

Example 7

Several grades of water-atomized stainless steel primary metal particles, namely:

- Ametek 316L ("316L"), which was obtained from Ametek Specialty Metal Products of Eight-Four, Pennsylvania;
- OMG 409Cb ("409Cb"), which was obtained from OMG Americas, now North American Höganäs, Inc. of Hollsopple, Pa.;
- OMG 410L ("410L"), which was obtained from OMG Americas, now North American Höganäs, Inc. of Hollsopple, Pa.; and
- OMG 434L ("434L"), which was obtained from OMG Americas, now North American Höganäs, Inc. of Hollsopple, Pa.;

were treated by wetting the surface of the metal particles with a warm solution of boric acid and xanthan gum. The treated powders were then dried in an oven for 1 hour at 150° C. For each of the inventive P/M Samples, the final composition was 0.15% by weight boron (in the form of $B_2O_3$) and 0.21% by weight dehydrated xanthan gum on the primary metal powders.

In the case of each of the inventive P/M Samples, the dried, treated metal powders formed friable agglomerates, which were easily broken using a roll crusher with low pressure on the rollers to break the material back to a powder without causing the dried boron/xanthan gum to be knocked off the surface of the primary metal particles. The powders were then screened through a 60-mesh screen and mixed with 0.40% by weight of Apex Ps1000b lubricant and 0.35% Apex Enhancer (a polymeric to aid green strength).

For purposes of comparison, the same grades of water atomized stainless steel metal particles were mixed with a conventional loading (1% by weight) of a conventional lubricant (Acrawax) to form P/M mixtures.

Figure 2:
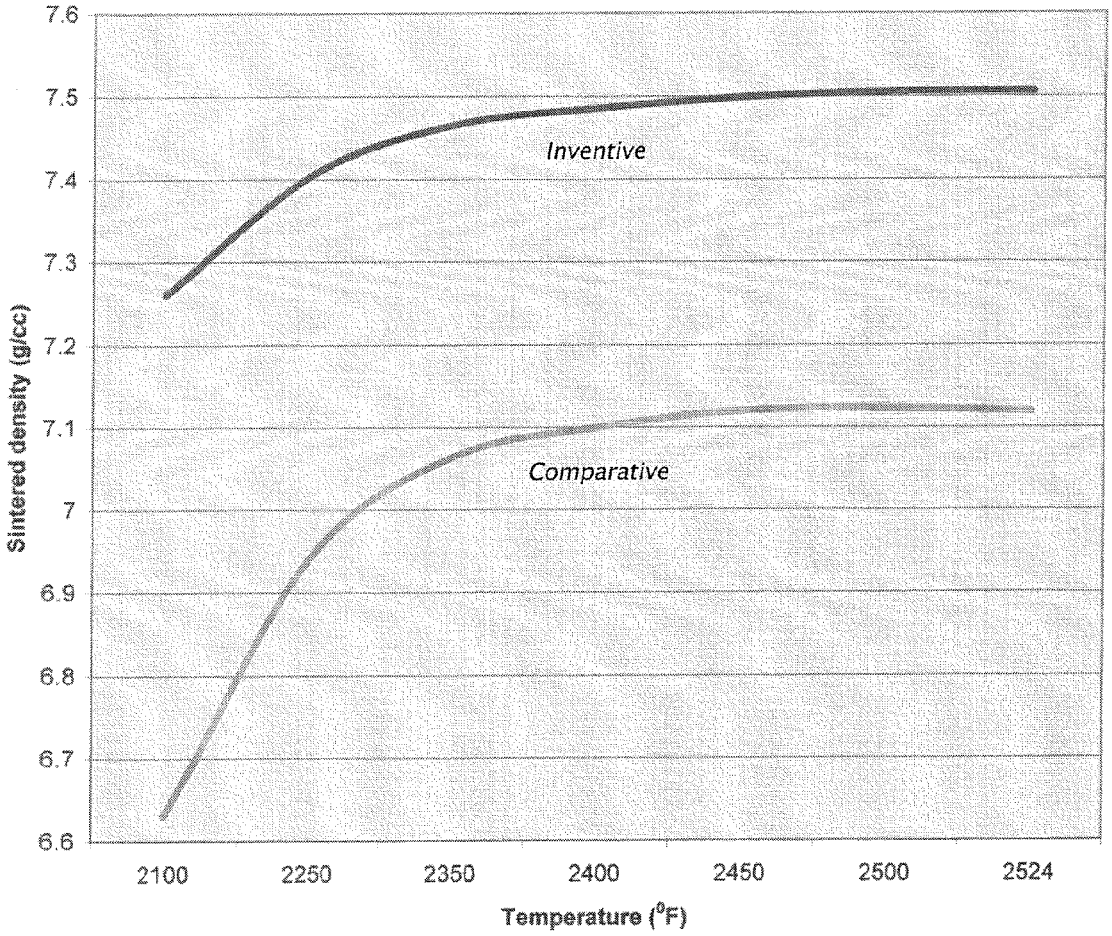
Figure 3:
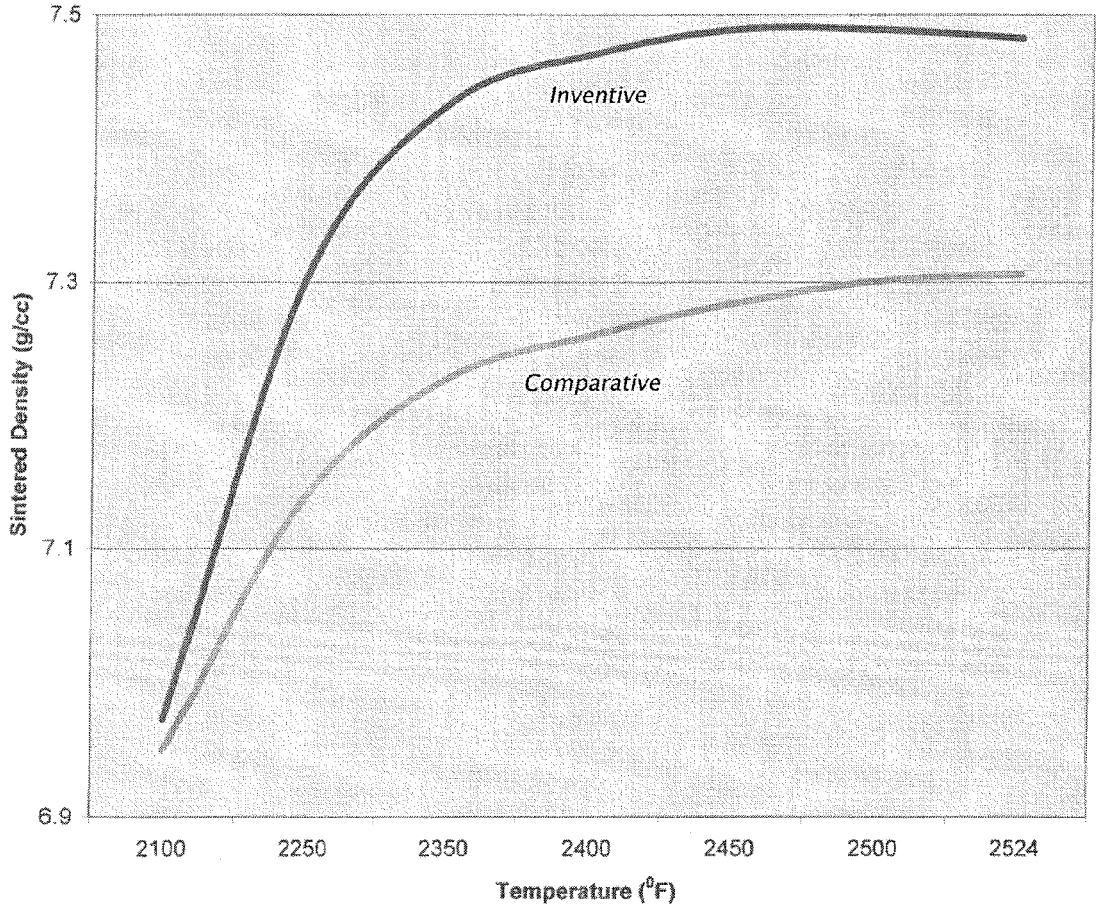
Figure 4:
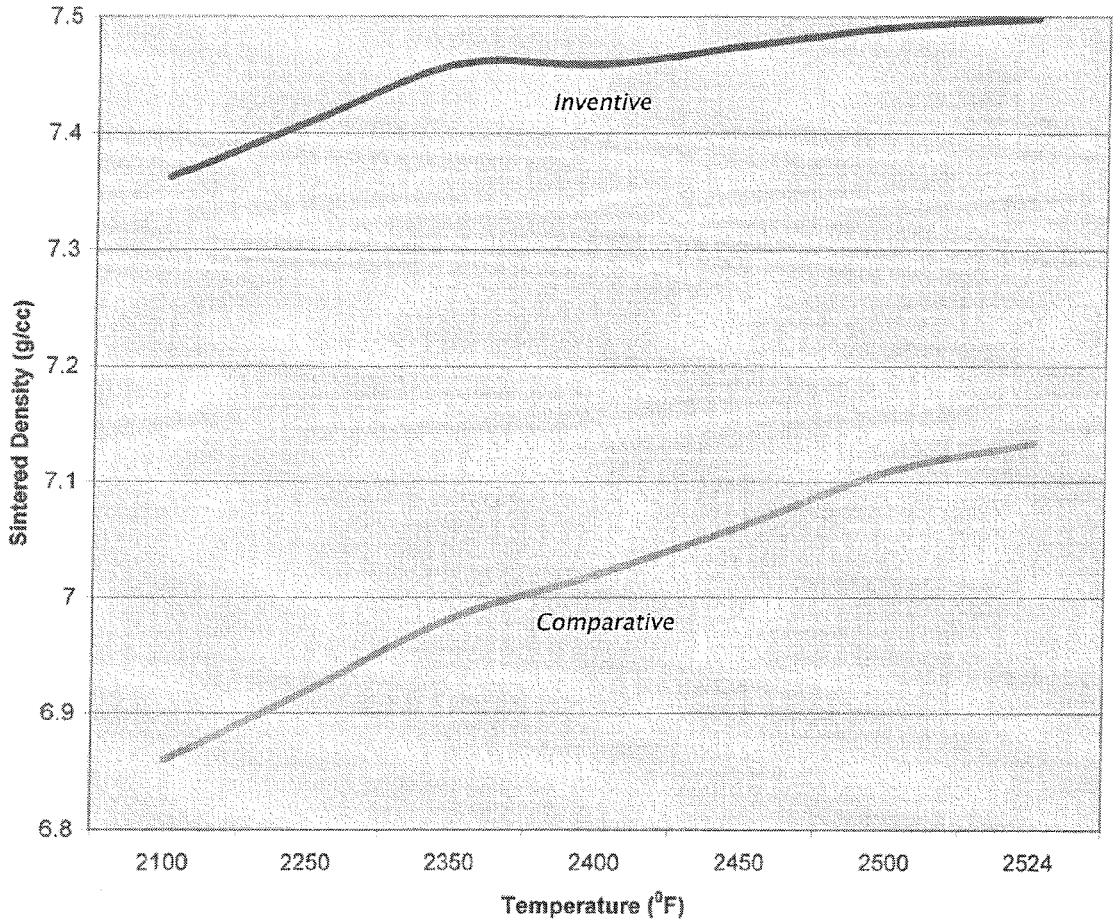

All of the mixtures (both inventive and comparative) were then pressed at 50 TSI into transverse rupture (TRS) bars. All of the TRS bars were placed on a Zircar ZAL 45AA porous plate and delubed on a continuous belt furnace using air at a peak temperature of 775° F. The test bars were then sintered at the peak sintering temperatures specified in Tables 5-8 below for 1 hour in the atmospheres specified in Tables 5-8 below. The heating rate was not rapid (it was 10-12° F./min) because there were not significant levels of liquid phase formers in the mixtures that could diffuse into the primary metal particles. FIG. 1 graphically illustrates the data shown in Table 5. FIG. 2 graphically illustrates the data shown in Table 6. FIG. 3 graphically illustrates the data shown in Table 7. And, FIG. 4 graphically illustrates the data shown in Table 8.

TABLE 5

"Inventive"
316L; 0.15% (wt) Boron; 0.21% (wt) Dehydrated Xanthan Gum
Green compaction at 50TSI = 6.72 g/cc

| Atmosphere | Peak Temperature | Sintered Density |
|---|---|---|
| 100% $H_2$ | 2250° F. | 7.24 g/cc |
| 100% $H_2$ | 2350° F. | 7.36 g/cc |
| 100% $H_2$ | 2450° F. | 7.67 g/cc |
| Vacuum | 2500° F. | 7.73 g/cc |
| 100% $H_2$ | 2524° F. | 7.82 g/cc |

"Comparative"
316L; 1% (wt) Acrawax
Green compaction at 50TSI = 6.72 g/cc

| Atmosphere | Temperature - ° F. | Density |
|---|---|---|
| 100% $H_2$ | 2100° F. | 6.88 g/cc |
| 100% $H_2$ | 2250° F. | 6.92 g/cc |
| 100% $H_2$ | 2350° F. | 6.98 g/cc |
| 100% $H_2$ | 2400° F. | 6.96 g/cc |
| 100% $H_2$ | 2450° F. | 7.09 g/cc |

TABLE 6

"Inventive"
409Cb; 0.15% (wt) Boron; 0.21% (wt) Dehydrated Xanthan Gum
Green compaction at 50TSI = 6.55 g/cc

| Atmosphere | Peak Temperature | Sintered Density |
|---|---|---|
| 100% $H_2$ | 2250° F. | 7.40 g/cc |
| 100% $H_2$ | 2350° F. | 7.48 g/cc |
| 100% $H_2$ | 2450° F. | 7.48 g/cc |
| Vacuum | 2500° F. | 7.51 g/cc |
| 100% $H_2$ | 2524° F. | 7.51 g/cc |

"Comparative"
409CbL; 1% (wt) Acrawax
Green compaction at 50TSI = 6.55 g/cc

| Atmosphere | Temperature - ° F. | Density |
|---|---|---|
| 100% $H_2$ | 2100° F. | 6.63 g/cc |
| 100% $H_2$ | 2250° F. | 6.94 g/cc |
| 100% $H_2$ | 2400° F. | 7.10 g/cc |

TABLE 7

"Inventive"
410L; 0.15% (wt) Boron; 0.21% (wt) Dehydrated Xanthan Gum
Green compaction at 50TSI = 6.65 g/cc

| Atmosphere | Peak Temperature | Sintered Density |
|---|---|---|
| 100% $H_2$ | 2250° F. | 7.30 g/cc |
| 100% $H_2$ | 2350° F. | 7.45 g/cc |
| 100% $H_2$ | 2450° F. | 7.47 g/cc |
| Vacuum | 2500° F. | 7.49 g/cc |
| 100% $H_2$ | 2524° F. | 7.49 g/cc |

TABLE 7-continued

| "Comparative" 410L; 1% (wt) Acrawax Green compaction at 50TSI = 6.65 g/cc | | |
|---|---|---|
| Atmosphere | Temperature - ° F. | Density |
| 100% $H_2$ | 2100° F. | 6.95 g/cc |
| 100% $H_2$ | 2250° F. | 7.14 g/cc |
| 100% $H_2$ | 2400° F. | 7.26 g/cc |

TABLE 8

| "Inventive" 434L; 0.15% (wt) Boron; 0.21% (wt) Dehydrated Xanthan Gum Green compaction at 50TSI = 6.50 g/cc | | |
|---|---|---|
| Atmosphere | Peak Temperature | Sintered Density |
| 100% $H_2$ | 2250° F. | 7.41 g/cc |
| 100% $H_2$ | 2350° F. | 7.45 g/cc |
| 100% $H_2$ | 2450° F. | 7.46 g/cc |
| Vacuum | 2500° F. | 7.51 g/cc |
| 100% $H_2$ | 2524° F. | 7.49 g/cc |
| "Comparative" 434L; 1% (wt) Acrawax Green compaction at 50TSI = 6.50 g/cc | | |
| Atmosphere | Temperature - ° F. | Density |
| 100% $H_2$ | 2100° F. | 6.86 g/cc |
| 100% $H_2$ | 2250° F. | 6.92 g/cc |
| 100% $H_2$ | 2400° F. | 7.02 g/cc |

Example 8

97.3 parts by weight of a compressible iron powder (Höganäs ABC100.30, which was obtained from North American Höganäs, Inc. of Hollsopple, Pa.) were mixed with 0.4 parts by weight of Apex Lubricant PS1000b, 0.2 parts by weight citric acid, 2 parts by weight graphite and 0.7 parts by weight silicon. The resulting metal powder composition was pressed into test bars as described in Example 2. The test bars, which had a green density of 7.0 g/cm$^3$, were delubed in a nitrogen atmosphere using a 10-15 minute hold at 325° F. and a 10-15 minute hold at 775° F. The test bars were then sintered in a 100% hydrogen atmosphere using a 10-12° F./min heat up rate to a peak temperature of 2250° F. Theoretical density was calculated to be ~7.75 g/cm$^3$. Sintered density was determined to be 7.77 g/cm$^3$, which is considered full density.

Example 9

Metal powder compositions A, B, C, D and E were formed by mixing the constituents shown in weight percent in Table 9 below:

TABLE 9

| Component | A | B | C | D | E |
|---|---|---|---|---|---|
| Astaloy 85MO(1) | 96.76 | — | — | — | — |
| Norilsk UT3(2) | 1.99 | — | — | 1.00 | 1.99 |
| Astaloy CRL(1) | — | 49.18 | 48.71 | 48.71 | — |
| ABC100.30(1) | — | 49.18 | 48.71 | 48.71 | — |
| Ancorsteel 30HP(3) | — | — | — | — | 96.31 |
| Chemalloy Electrolytic(4) | — | — | 0.99 | — | |
| Asbury PF55(5) | 0.65 | 0.89 | 0.89 | 0.89 | 0.90 |
| Apex Superlube PS1000b(6) | 0.40 | 0.40 | 0.40 | 0.40 | 0.40 |
| Citric Acid | 0.20 | 0.35 | 0.30 | 0.35 | 0.40 |
| Total | 100 | 100 | 100 | 100 | 100 |

(1)Obtained from North American Höganäs, Inc. of Hollsopple, Pennsylvania;
(2)Obtained from Norilsk Nickel of Moscow, Russia;
(3)Obtained from Hoeganaes Corporation of Cinnaminson, New Jersey;
(4)Manganese powder (fine) obtained from Chemalloy Company, Inc. of Bryn Mar, Pennsylvania;
(5)Graphite obtained from Asbury Graphite and Carbon Inc. of Asbury, New Jersey; and
(6)Obtained from Apex Advanced Technologies of Cleveland, Ohio.

Metal powder compositions A, B, C, D and E were pressed into test bars as described in Example 2. The test bars were delubed in a nitrogen atmosphere using a 10-15 minute hold at 325° F. and a 10-15 minute hold at 775° F. The test bars were then sintered in a continuous batch vacuum furnace using a 190° F./min heat up rate to a peak sintering temperature of 2500° F. Green and sintered density values are reported in Table 12 below.

TABLE 12

| P/M Composition | Green Density | Sintered Density |
|---|---|---|
| A | 7.28 g/cm$^3$ | 7.76 g/cm$^3$ |
| B | 7.13 g/cm$^3$ | 7.71 g/cm$^3$ |
| C | 7.17 g/cm$^3$ | 7.66 g/cm$^3$ |
| D | 7.13 g/cm$^3$ | 7.70 g/cm$^3$ |
| E | 7.04 g/cm$^3$ | 7.78 g/cm$^3$ |

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A method of forming a metal part comprising the steps of:

(i) providing a metal powder composition comprising a blend of primary metal particles of iron, pre-alloyed iron, aluminum, pre-alloyed aluminum, copper or pre-alloyed copper, said primary metal particles having an outer surface comprising a metal oxide, and an organics package that is capable of being spread onto the outer surface of the primary metal particles, the organics package comprising an organic lubricant, an organic acid and/or an organic compound other than the lubricant or organic acid that leaves a carbon residue on the outer surface of the primary metal particles subsequent to a delubing step;

(ii) compacting the metal powder composition within a die cavity to form a green compact, wherein the organics package is spread onto the outer surface of the primary metal particles in the green compact;

(iii) delubing the green compact in an inert atmosphere; and (iv) sintering the delubed green compact to a peak sintering temperature at a heat up rate of 60° F./min or higher to form the metal part, wherein the metal oxides on the surface of the primary metal particles in the green compact are removed in situ in a reaction with the organic acid, lubricant and/or the carbon residue from the organic compound other than the lubricant or organic acid at a temperature below which liquid phase bonding and/or solid state diffusion occurs in the sintering step, and wherein the metal part has a sintered density that is ≧26% of a theoretical density for all metallic constituents of the metal powder composition immediately after the sintering step and prior to any further post-sintering densification steps.

2. The method according to claim 1 wherein the primary metal particles contain iron and optionally ≦8% by weight of one or more alloying elements, wherein the metal powder composition further comprises one or more liquid phase forming materials or precursors thereof, and wherein the metal part contains iron and ≦8% by weight of alloying elements.

3. The method according to claim 1 wherein the primary metal particles consist essentially of iron, wherein the metal powder composition further comprises one or more liquid phase forming materials or precursors thereof containing elements selected from the group consisting of carbon, silicon, manganese and phosphorous, and wherein the metal part contains ≧0.5% by weight of carbon.

4. The method according to claim 1 wherein the primary metal particles comprise iron, wherein the primary metal particles are either pre-alloyed with >8% by weight of one or more alloying elements and/or are ad-mixed with >8% by weight of particles of alloying elements, wherein the metal powder composition further comprises a boron-containing liquid phase forming material or precursor thereof, and wherein the organics package comprises a water soluble polymer.

5. The method according to claim 1 wherein the primary metal particles comprise a copper alloy or an aluminum alloy.

6. A method of forming a metal part comprising the steps of:

(i) providing a metal powder composition comprising a blend of primary metal particles having an outer surface comprising a metal oxide, wherein said primary metal particles comprise stainless steel and wherein boron is distributed on the outer surface of the primary metal particles, and an organics package that is capable of being spread onto the outer surface of the primary metal particles, the organics package comprising an organic lubricant, an organic acid and/or an organic compound other than the lubricant or organic acid that leaves a carbon residue on the outer surface of the primary metal particles subsequent to a delubing step;

(ii) compacting the metal powder composition within a die cavity to form a green compact, wherein the organics package is spread onto the outer surface of the primary metal particles in the green compact;

(iii) delubing the green compact; and (iv) sintering the delubed green compact to form the metal part, wherein the metal oxides on the surface of the primary metal particles in the green compact are removed in situ in a reaction with the organic acid, lubricant and/or the carbon residue from the organic compound other than the lubricant or organic acid at a temperature below which liquid phase bonding and/or solid state diffusion occurs in the sintering step, and wherein the metal part has a sintered density that is ≧96% of a theoretical density for all metallic constituents of the metal powder composition immediately after the sintering step and prior to any further post-sintering densification steps.

* * * * *